US009126804B2

(12) United States Patent
Widmer

(10) Patent No.: US 9,126,804 B2
(45) Date of Patent: Sep. 8, 2015

(54) TRIGGERING OF AN ELEVATOR BRAKE IN AN EMERGENCY SITUATION

(75) Inventor: Heinz Widmer, Rotkreuz (CH)

(73) Assignee: Inventio AG, Hergiswil (CH)

( * ) Notice: Subject to any disclaimer, the term of this patent is extended or adjusted under 35 U.S.C. 154(b) by 613 days.

(21) Appl. No.: 13/569,293

(22) Filed: Aug. 8, 2012

(65) Prior Publication Data

US 2013/0043097 A1 Feb. 21, 2013

(30) Foreign Application Priority Data

Aug. 16, 2011 (EP) ..... 11177714

(51) Int. Cl.
*B66B 1/32* (2006.01)
*B66B 5/02* (2006.01)

(52) U.S. Cl.
CPC ..... *B66B 5/02* (2013.01)

(58) Field of Classification Search
CPC ..... B66B 1/32; B66B 5/0018; B66B 5/0031; B66B 5/02; B66B 5/028
USPC ..... 187/247, 248, 281, 286, 287, 288, 289, 187/290, 293, 296, 297, 298, 305, 306, 314, 187/391–393
See application file for complete search history.

(56) References Cited

U.S. PATENT DOCUMENTS

| | | | | |
|---|---|---|---|---|
| 4,359,208 | A | 11/1982 | Kelm et al. | |
| 4,974,703 | A * | 12/1990 | Nomura | 187/288 |
| 7,730,998 | B2 * | 6/2010 | Takahashi et al. | 187/288 |
| 7,891,466 | B2 * | 2/2011 | Okamoto et al. | 187/288 |
| 8,316,996 | B2 * | 11/2012 | Hashimoto et al. | 187/288 |
| 8,752,677 | B2 * | 6/2014 | Harkonen et al. | 187/391 |
| 2013/0213745 | A1 * | 8/2013 | Kattainen et al. | 187/288 |

FOREIGN PATENT DOCUMENTS

| | | | |
|---|---|---|---|
| GB | 2153465 | A | 8/1985 |
| JP | 7-157211 | A | 6/1995 |
| WO | 97/42118 | A1 | 11/1997 |

* cited by examiner

*Primary Examiner* — Anthony Salata
(74) *Attorney, Agent, or Firm* — Fraser Clemens Martin & Miller LLC; William J. Clemens

(57) ABSTRACT

A method for triggering an elevator brake in an emergency situation of a vertically movable elevator car in an elevator installation, wherein a movable part of the brake is held in a starting position by an electromagnetic force generated by a coil connected with a voltage source, and for triggering the brake the voltage supplied to the coil is interrupted and the movable part is moved from the starting position to a braking position by a spring force of at least one spring. A voltage is set by a switching unit that is connected with a control unit in dependence on at least one travel parameter of the elevator car determined by the control unit and, in the case of failure of the voltage source, triggering of the elevator brake is delayed by a delay unit in dependence on the set voltage.

10 Claims, 5 Drawing Sheets

TRIGGERING OF AN ELEVATOR BRAKE IN AN EMERGENCY SITUATION

CROSS-REFERENCE TO RELATED APPLICATION

This application claims priority to European Patent Application No. 11177714.0, filed Aug. 16, 2011, which is incorporated herein by reference.

FIELD

The invention relates to a method in an emergency situation for triggering an elevator brake of an elevator installation comprising at least one vertically movable elevator car, wherein at the elevator brake a movable part is held in the starting position by means of an electromagnetic force of at least one coil connected with at least one voltage source and wherein for triggering the elevator brake the voltage supply of the coil is interrupted and the movable part is moved from the starting position to a braking position by means of a spring force of at least one spring.

BACKGROUND

Elevator brakes must, in the case of emergency, respond rapidly and stop the elevator car and the counterweight without delay. Known elevator brakes comprise at least one spring or brake spring generating a braking force, wherein an electromagnetic device with at least one electromagnetic coil operates against the spring force and in that case holds the brake, inter alia, in a starting position. When the voltage to the coil is switched off, the magnetic field of the coil collapses and a brake unit or a movable part of the elevator brake presses, by virtue of the spring force of the at least one brake spring, against, for example, a brake disc, an elevator rail, etc. The brake unit is in that case accelerated under the action of the spring force of the brake spring and presses against the brake disc, the elevator rail, etc., to achieve a braking action. The brake unit usually presses from one side and a further brake unit from the opposite side against the brake disc, as is known from, for example, WO 97/42118.

In an emergency situation, i.e., for example, in the case of loss of the current or voltage supply of an elevator installation, the elevator brake is triggered and thus the elevator car stopped. However, in certain situations it can happen that the elevator brake brakes too strongly and thus too abruptly. This can be case, inter alia, if the elevator car travels upwardly fully loaded or travels downwardly empty or only with a small load.

SUMMARY

It is an object of the invention to propose a simple and efficient possibility for a situation-adapted braking of an elevator car in an emergency situation.

A core of the invention consists in that a voltage is set by means of at least one switching unit, which is connected with the control unit, in dependence on at least one travel parameter, which is determined by a control unit, of an elevator car of an elevator installation and, in the case of failure of the voltage supply, triggering of an elevator brake is delayed by means of a delay unit in dependence on the set voltage. The travel direction and/or the load of the elevator car, inter alia, can be used as travel parameter.

The elevator installation comprises at least one vertically movable elevator car, which is braked by the elevator brake.

The elevator brake comprises a movable part, which is held in a starting position by means of an electromagnetic force of at least one coil connected with at least one voltage source. In order to trigger the elevator brake or for braking, the voltage supply of the coil is interrupted so that the movable part is moved from the starting position to a braking position by means of a spring force of at least one spring. This can happen in that, for example, the current circuit with the voltage source is interrupted by a switch or in that the voltage source fails.

In principle, any voltage source can be used as the voltage source, such as, for example, a direct voltage source, a public power mains, a battery, an alternating voltage source, etc.

The voltage set by the at least one switching unit or the set voltage value can be positive or negative. The amount of the voltage value in that case depends on, for example, the elevator brake which is used.

Electrical components, inter alia active and/or passive components, such as, for example, a switch, a resistance, a regulable resistance, a relay, a microprocessor, etc., can be used for the at least one switching unit. The at least one switching unit can in that case consist of a single component or of a switching arrangement with several components. Thus, at least one electrical component can be used as at least one switching unit.

At least one signal can be transmitted to the switching unit from the control unit, for example of an elevator control unit, for setting the voltage. Thus, for example, the switching unit can set the voltage in dependence on this transmitted signal. An analog and/or digital signal can be used as at least one signal. The signal for setting a specific voltage can be transmitted by the control unit on the basis of at least one rule. Thus, a rule of that kind could read, inter alia, that in the case of an upwardly travelling fully laden or a downwardly travelling lightly laden elevator car use is made of a different voltage than in the case of a lightly laden upwardly travelling or fully laden downwardly travelling elevator car.

In addition, a second switching unit connected in series with the first could also be used. Thus, the first switching unit could set a voltage and only when the second switching unit is switched or closed is the coil supplied with the voltage. However, this also means that the current supply can be interrupted in an emergency situation and thus the elevator brake triggered. The second switching unit can in that case, for example, be a switching element of a safety circuit of an elevator installation.

The delay unit consists of at least one electrical component, inter alia, an active and/or passive component. A possible construction can in that case be that, for the delay unit, at least one first resistance and second resistance are used, wherein as second resistance a greater resistance than in the case of the first resistance is selected (second resistance $R_2$>, >>first resistance $R_1$).

An advantage of the invention consists in that the braking force can be regulated or delayed in an emergency situation in a simple mode and manner so that in specific situations, for example in the case of a fully laden upwardly travelling or lightly laden downwardly travelling elevator car, an excessively strong and abrupt braking of the elevator car does not take place, but nevertheless the elevator car be braked within the European Safety Standard EN81. A strong and abrupt braking can involve a risk of injury for persons within the elevator car or can excessively and unnecessarily load elevator components such as, for example, the support means, drive pulley, drive unit, deflecting rollers, elevator brake, etc.

A further advantage of the invention consists in that the method can be used with only low financial outlay even in the case of existing elevator installations.

DESCRIPTION OF THE DRAWINGS

The above advantages, as well as other advantages of the present invention, will become readily apparent to those skilled in the art from the following detailed description of a preferred embodiment when considered in the light of the accompanying drawings in which.

DETAILED DESCRIPTION

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
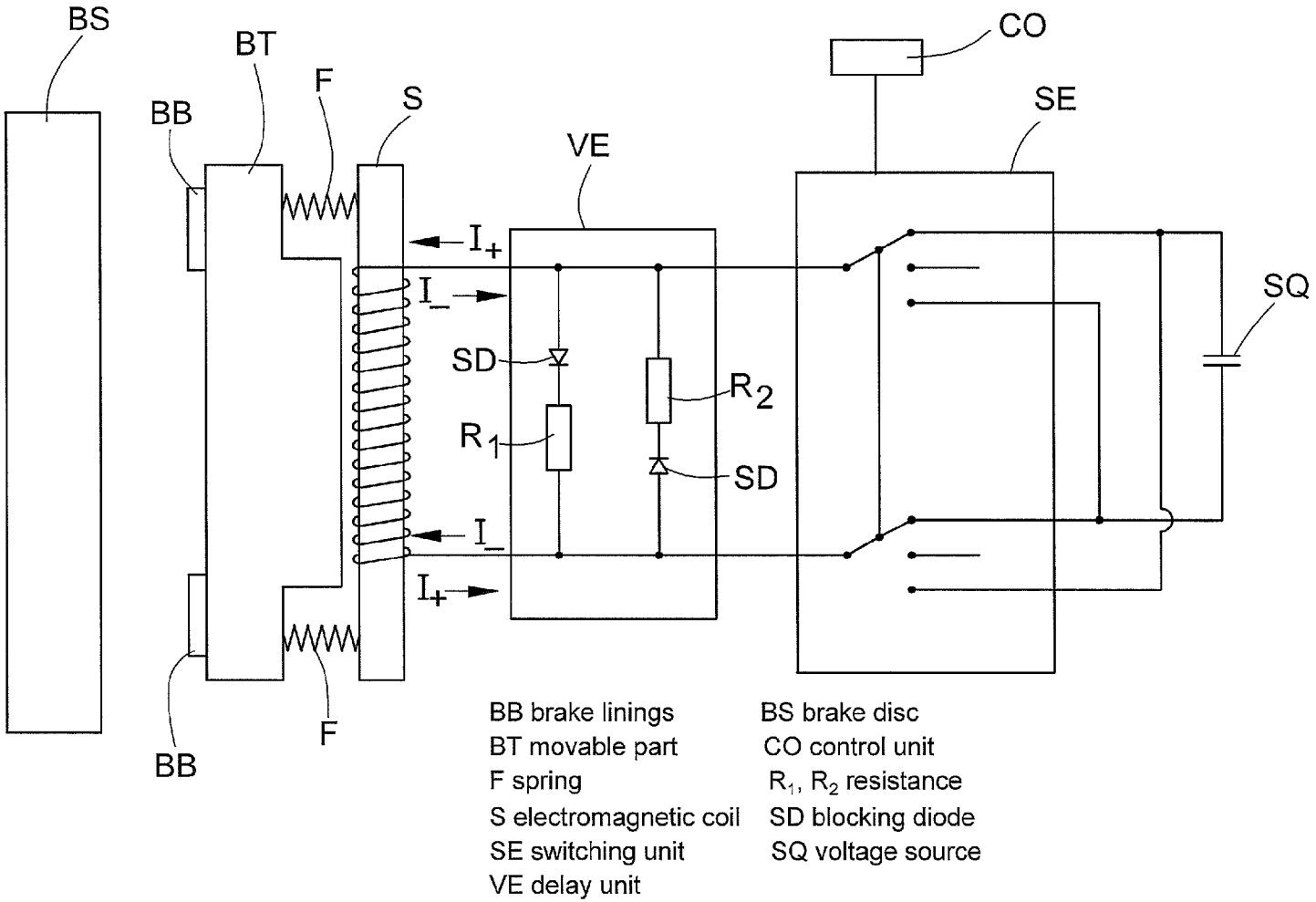
FIG. 1 is a simplified schematic diagram of a first embodiment of an elevator brake according to the invention.

FIG. 1 shows a simplified schematic diagram of a first embodiment of an elevator brake of an elevator installation. An electromagnetic coil S, which holds a movable part BT with brake linings BB (not described in more detail) in a starting position by means of an electromagnet force when the electromagnetic coil S is supplied with a voltage or current from at least one voltage source SQ, is shown. If the current or voltage supply is interrupted, the movable part BT moves by virtue of a spring force of at least one biased spring F into a braking position and, for example, in that case presses against a brake disc BS. On restoration of the current or voltage supply, for example by closing the current circuit with the voltage source SQ, connection of the voltage source SQ, etc., the electromagnetic force of the electromagnetic coil S counteracts the spring force of the at least one spring F and moves the movable part BT towards the starting position.

A control unit CO ascertains at least one travel parameter of an elevator car of the elevator installation associated with the elevator brake. This can take place, for example, by means of sensor values of at least one sensor of the elevator installation, on the basis of data of input elevator travel requirements, etc. The loading and/or the travel direction of the elevator car can, for example, be used as a travel parameter. The speed, the distance from the next stopping floor, etc., could obviously also be used as travel parameters.

A switching unit SE connected with the control unit CO sets a voltage in dependence on the at least one travel parameter determined by the control unit CO. The switching unit SE is in that case connected with the voltage source SQ and the elevator brake. The switching unit SE can be integrated in the elevator brake or in the voltage source SQ. It (SE) can, however, also be constructed as a separate unit. The control unit CO can be connected with the switching unit SE by way of a communications network, for example a bus system, a hardwired communications network, a non-hardwired communications network, etc.

The control unit CO can, in dependence on at least one rule and the determined travel parameter, transmit to the switching unit SE at least one signal for setting a voltage. Thus, for example, a rule could read that in the case of a fully laden upwardly travelling or in the case of an almost empty or empty downwardly travelling elevator car a different voltage is to be set than in the case of an almost empty or empty upwardly travelling or fully laden downwardly travelling elevator car. In addition, a specific voltage could be set by the switching unit from a defined speed. The at least one signal is of whatever form. Thus, depending on the respective switching unit SE use can be made of an analog or a digital signal.

In this example, at least two switches with three switch settings are used for setting the voltage in the case of the switching unit SE. It is thereby possible in this embodiment to produce a positive voltage value, a negative voltage value and an interruption of the current or voltage supply. The switching unit SE basically consists of electrical components, for example active and/or passive components, so that a specific voltage or a specific current can be set.

In the case of failure of the voltage or current supply by the voltage source SQ the elevator brake is triggered. In that case, triggering of the elevator brake is delayed by means of a delay unit VE in dependence on the set voltage. For that purpose the delay unit VE is connected with the switching unit SE and the coil S of the elevator brake. The delay unit VE can then be integrated in the elevator brake or can be constructed as a separate unit.

The delay unit VE consists of electric components, for example active and/or passive components, such as, for example, a resistance, a capacitor, a diode, a microprocessor, etc. In this embodiment the delay unit comprises a first resistance element $R_1$ and a second resistance element $R_2$, which are connected in parallel, and a respective blocking diode SD. The blocking diode SD has the effect that the current or the voltage can flow only in a defined direction. A resistance value of the second resistance $R_2$ is, in this example, greater than a resistance value of the first resistance $R_1$.

In this embodiment either a positive voltage value or current value $I_+$ or a negative voltage value or current value $I_-$ is set by the switching unit SE. The current thereby flows either through the first resistance $R_1$ or through the second resistance $R_2$ and in both cases through the coil. In the case of interruption of the current or voltage supply there is induced, as a consequence of a change in the current, a voltage in the coil S which is opposite to the voltage previously applied by the voltage source SQ. As a result, in the case of an original positive voltage or current value $I_+$ a current through the (larger) resistance $R_2$ of the delay unit VE is now produced, whereas due to a diode a current no longer flows through the resistance $R_1$. The voltage lying at the resistance $R_2$ and the voltage lying at the coil S are identical, because the resistance $R_2$ for a given current generates a voltage which is large by comparison with the first resistance $R_1$. In correspondence with induction law, which states that the current change in a coil S is proportional to the voltage across the coil, the current through the coil S also reduces correspondingly quickly.

In the case of an original negative voltage or current value $I_-$ a current through the (smaller) resistance $R_1$ of the delay unit VE is produced, whereas due to a diode current no longer flows through the resistance $R_2$. Because the resistance $R_1$ produces a small voltage by comparison with the second resistance $R_2$, the current through the coil S is correspondingly slower and thus reduces with delay, as a result of which the triggering of the elevator brake can be delayed, wherein, for example, the delay time can lie in the range of milliseconds to seconds. The delay takes place in this example due to the fact that different resistances $R_1$, $R_2$ are used for positive or negative voltage values.

Figure 2:
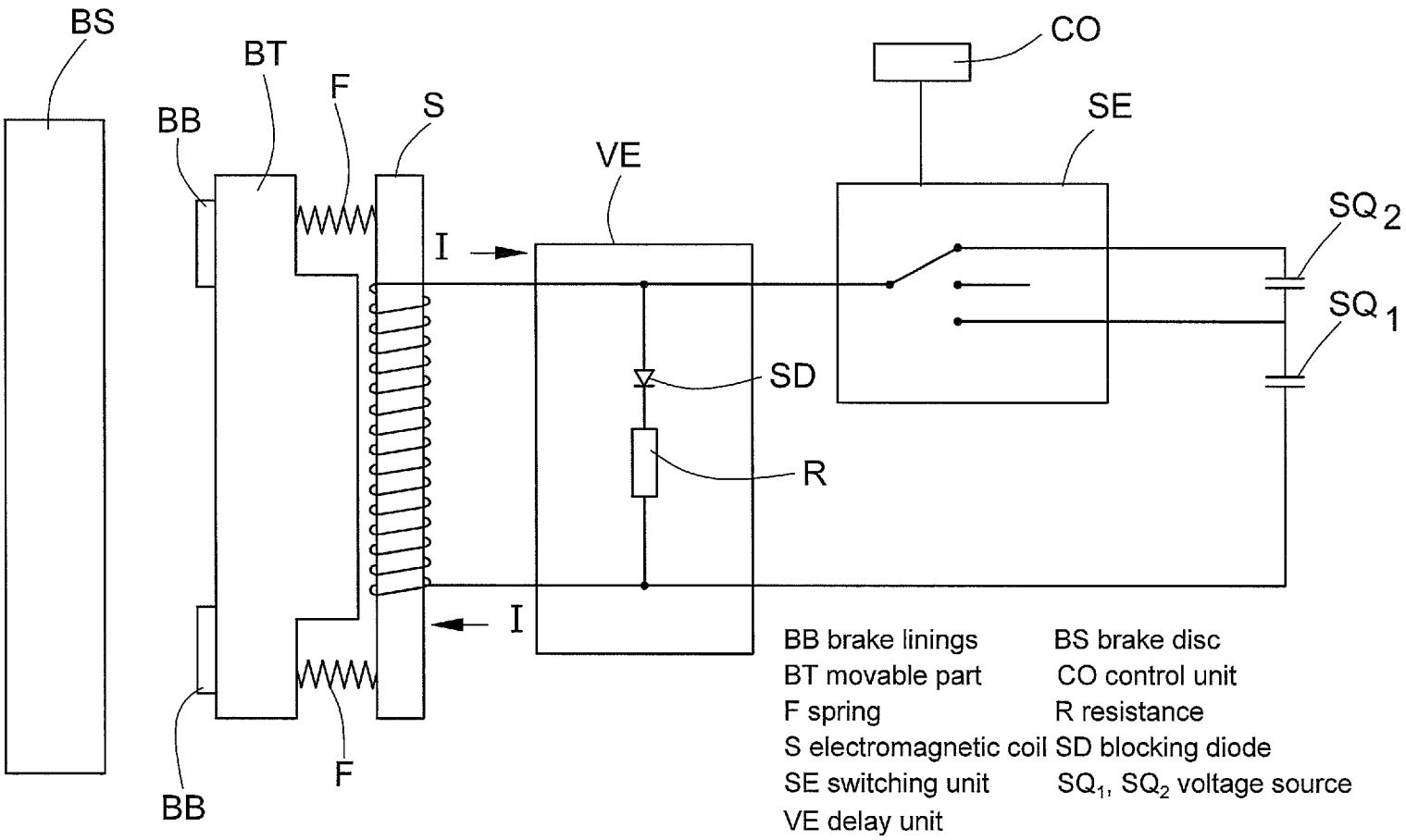
FIG. 2 is a simplified schematic diagram of a second embodiment of the elevator brake.

FIG. 2 shows a simplified schematic diagram of a second embodiment of the elevator brake. This embodiment differs from the embodiment shown in FIG. 1 in that two voltage sources $SQ_1$, $SQ_2$ are used, which have different voltages.

The switching unit SE is in that case designed so that it (SE) can set, for example, by means of a switch, a first voltage or a first current from the first voltage source $SQ_1$ or a second voltage or a second current from the second voltage source $SQ_2$. The first and second voltage or current values are in this example different in terms of amount.

The delay unit VE in this example comprises a resistance R and a blocking diode SD. Depending on which voltage or current value was set by the switching unit SE, triggering of the elevator brake is delayed to a greater or lesser extent with respect to the induction law described in reference to FIG. 1.

Figure 3:
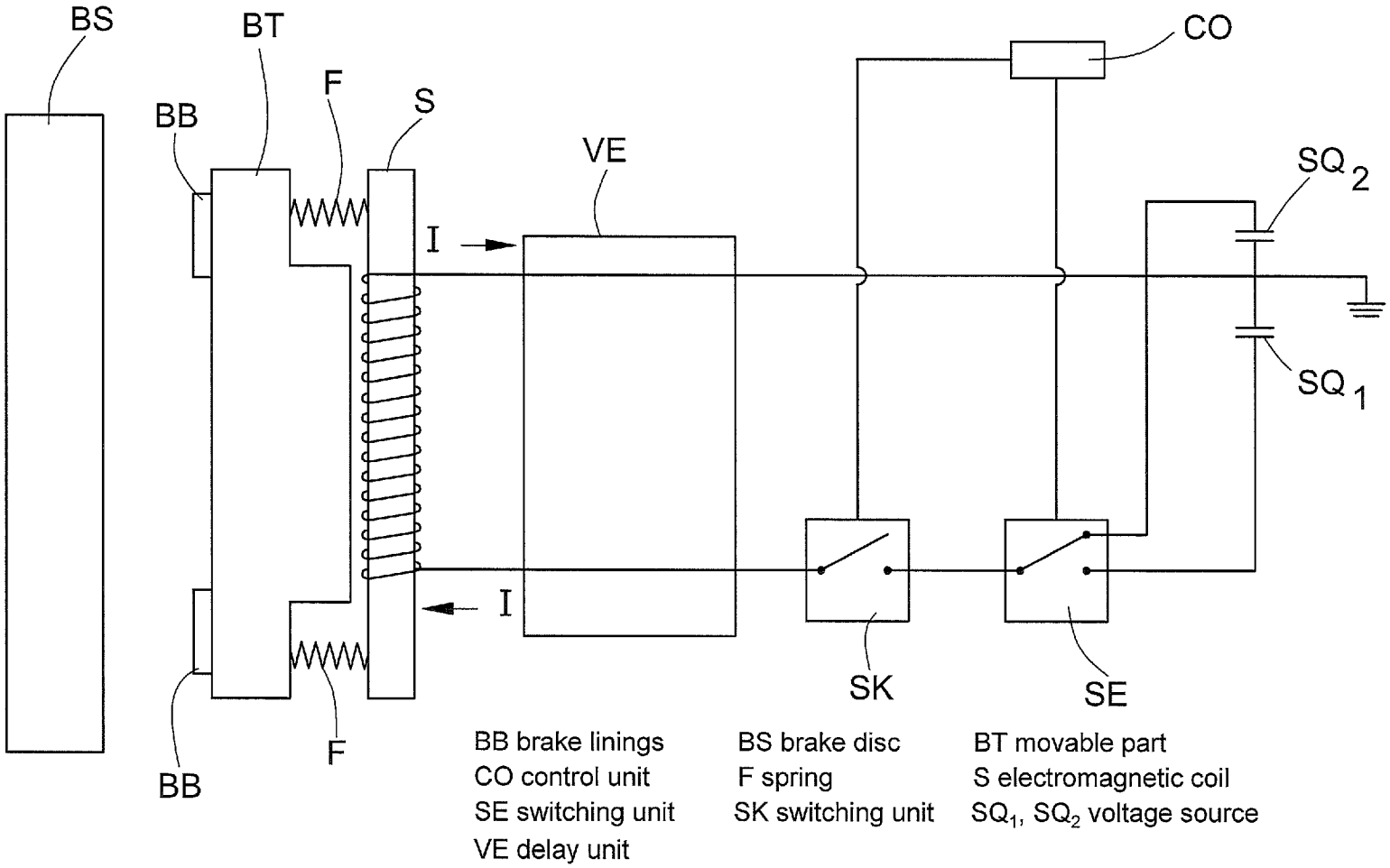
FIG. 3 is a simplified schematic diagram of a third embodiment of the elevator brake.

FIG. 3 shows a simplified schematic diagram of a third embodiment of the elevator brake. This embodiment comprises, like the second embodiment in FIG. 2, a first voltage source $SQ_1$, a second voltage source $SQ_2$ and a switching unit SE, which unit can set either a first voltage or current value of the first voltage source $SQ_1$ or a second voltage or current value of the second voltage source $SQ_2$. Additionally to FIGS. 1 and 2, this embodiment also has a second switching unit SK.

The second switching unit SK can be, for example, a switching element of a safety circuit of an elevator installation and connected by way of a communications network with the control unit CO. The second switching unit SK represents an additional safety feature. Thus, the control unit CO can in an emergency situation interrupt the current or voltage supply and thus trigger the elevator brake. The voltage or current supply through the first voltage source $SQ_1$ or second voltage source $SQ_2$ does not in that case have to drop out. The voltage or current supply can be interrupted merely by the second switching unit SK.

The delay unit VE also includes, in this embodiment, electrical components which enable delay of triggering of the elevator brake. Thus, in the case of the delay unit VE, as in FIGS. 1 and 2, resistances R, $R_1$, $R_2$ can be used for delaying to a greater or lesser extent; also conceivable, however, are other components such as, for example, at least one capacitor, transistor, microprocessor.

The voltage decay in the coil S could be regulated by means of a regulated semiconductor circuit as the delay unit VE in the embodiments according to FIGS. 1 to 3, which can comprise at least one transistor, microprocessor, etc. Thus, on the basis of the regulated voltage decay of the coil S through the delay unit VE the magnetic force of the coil S could counteract the spring force of the at least one spring F and thus the braking force of the elevator brake could be regulated.

Figure 4:
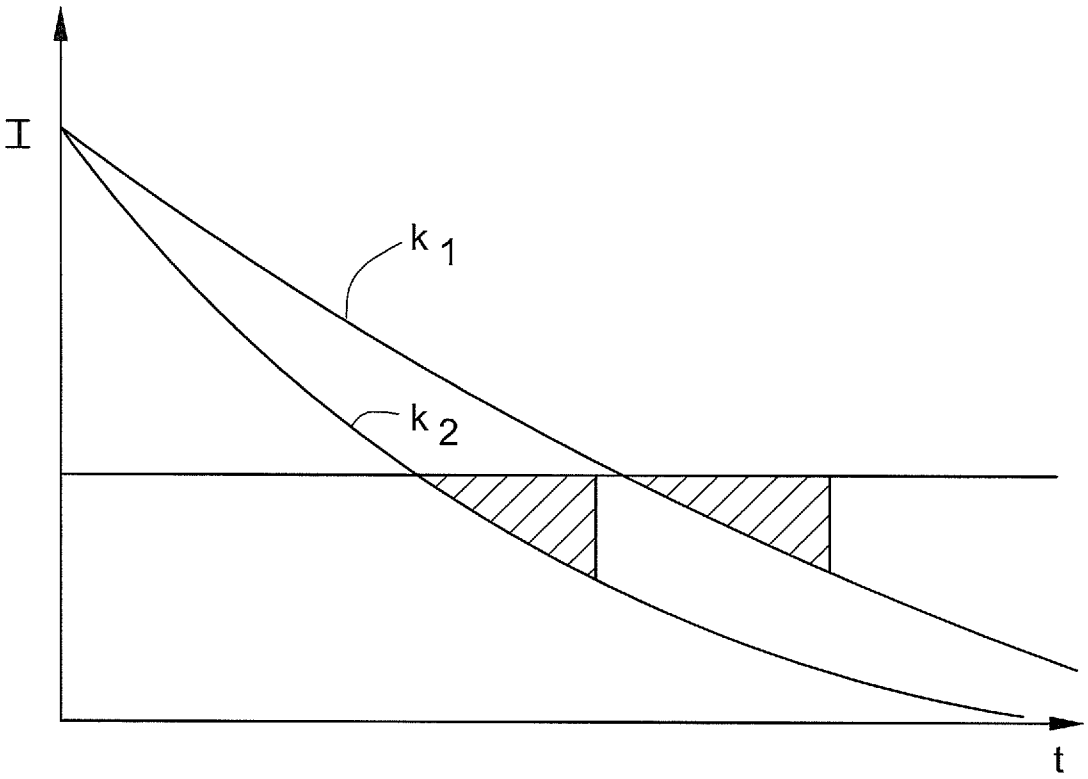
FIG. 4 is an example delay diagram in correspondence with the first and third embodiments of the elevator brake.

FIG. 4 shows an example of a delay diagram in correspondence with the first and third embodiments of elevator brake according to FIGS. 1 and 3. In the delay diagram, time t is recorded against the amount of the current amperage I. The delay of the triggering of the elevator brake in that case takes place exponentially in principle by $|I(t)|=I_0\cdot e^{-k_i(t-t_0)}$, wherein in this example $t_0=0$. The factor $k_1$, wherein i=1, 2, 3, 4, indicates the delay and can be changed by selection of the resistances R, $R_1$, $R_2$. In the embodiment of FIG. 1 the output voltage or output current, which was set by the switching unit SE, is the same in terms of amount. The delay factor k is different, thus $k_1 \neq k_2$.

Figure 5:
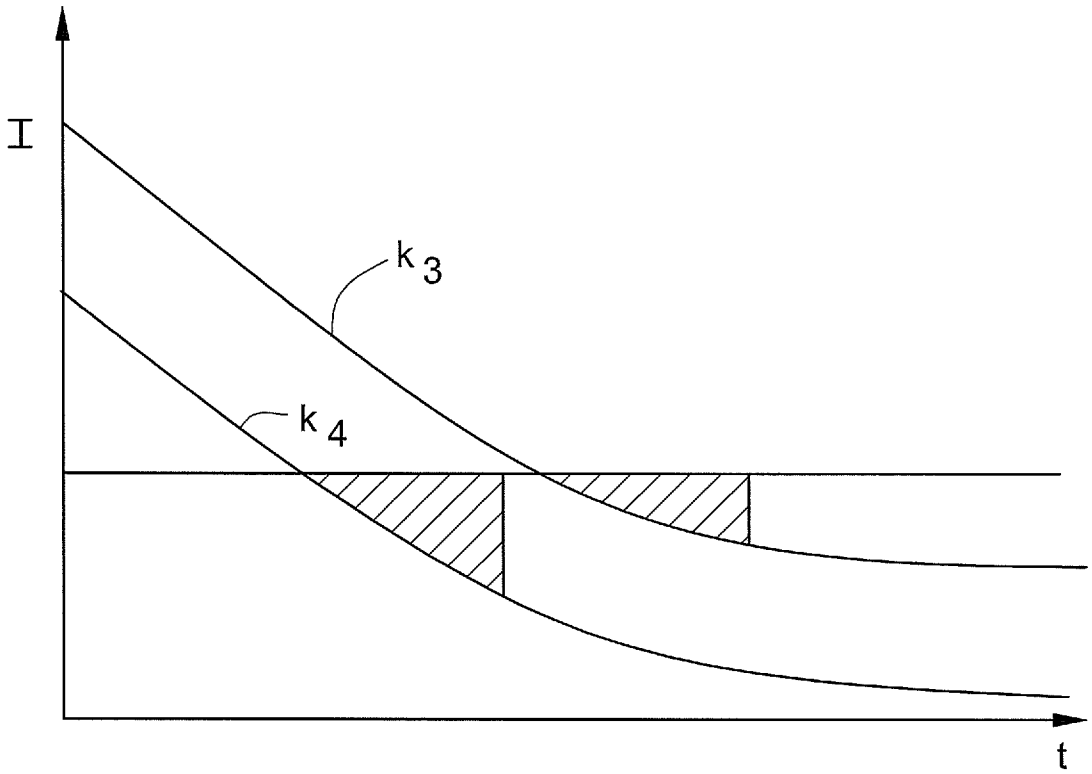
FIG. 5 is an example delay diagram in correspondence with the second embodiment of the elevator brake.

FIG. 5 shows an example of a delay program in correspondence with the second or third embodiment of the elevator brake according to FIG. 2. The time t is again recorded against the amount of the current amperage I. The delay of the triggering of the elevator brake takes place in that case again exponentially by $|I(t)|=I_0\cdot e^{-k_i(t-t_0)}$. In this embodiment, the amounts of the current amperage I at the time instant $t_0$ are different, but the delay factors $k_3$ and $k_4$ are the same, thus $k_3=k_4$. The delay unit VE thus identically delays every voltage set by the switching unit SE.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method in an emergency situation for triggering an elevator brake of an elevator installation including a vertically movable elevator car, comprising the steps of:

holding a movable part of the elevator brake in a starting position by an electromagnetic force generated by a coil connected to a voltage source;

triggering the elevator brake by interrupting voltage supplied to the coil from the voltage source wherein the movable part is moved from the starting position to a braking position by a spring force of at least one spring;

setting a voltage by operating a switching unit connected with a control unit in dependence on at least one travel parameter of the elevator car determined by the control unit; and in response to a failure of the voltage source, triggering of the elevator brake is delayed by a delay unit in dependence on the set voltage.

2. The method according to claim 1 wherein the set voltage has one of a positive voltage value and a negative voltage value.

3. The method according to claim 1 wherein the switching unit is at least one of an electrical component, a switch, a regulable resistance, a relay, a microprocessor, an active component, a passive component and a resistance.

4. The method according to claim 1 including transmitting at least one signal from the control unit to the switching unit for setting the voltage.

5. The method according to claim 4 including generating the at least one signal in dependence on the at least one travel parameter and at least one rule.

6. The method according to claim 1 wherein the switching unit is a first switching unit and including connecting a second switching unit in series with the first switching unit.

7. The method according to claim 6 including using a switching element of a safety chain of the elevator installation as the second switching element.

8. The method according to claim 1 including using a first resistance element and a second resistance element in the delay unit, wherein the second resistance element has a greater resistance value than a resistance value of the first resistance element.

9. The method according to claim 1 including using at least one of a travel direction of the elevator car and a loading of the elevator car as the at least one travel parameter.

10. A device for triggering an elevator brake in an emergency situation of an elevator installation having a vertically movable elevator car, comprising:

a movable part of the elevator brake;

at least one spring applying a spring force to the movable part;

a coil connected to a voltage source and generating an electromagnetic force maintaining the movable part in a starting position, wherein interruption of voltage supplied to the coil by the voltage source triggers the elevator brake and the movable part is moved from the starting position to a braking position by the spring force applied by the at least one spring;

a switching unit connected with a control unit setting a voltage in dependence on at least one travel parameter of the elevator car determined by the control unit; and a delay unit wherein upon failure of the voltage supply the delay unit delays triggering of the elevator brake in dependence on the set voltage.

* * * * *